US005497991A

United States Patent [19]

Huang

[11] Patent Number: 5,497,991

[45] Date of Patent: Mar. 12, 1996

[54] CHANGEABLE MAZE GAME

[76] Inventor: Hua-Yu Huang, 5F 1, Lane 151 Sec. 3 Chien Kuo N. Road, Taipei, Taiwan

[21] Appl. No.: 377,993

[22] Filed: Jan. 25, 1995

[51] Int. Cl.[6] ..... A63F 9/10

[52] U.S. Cl. ..... 273/157 R; 273/275

[58] Field of Search ..... 273/153 R, 155, 273/157 R, 157 A, 05498835782.1

[56] References Cited

U.S. PATENT DOCUMENTS

| | | | |
|---|---|---|---|
| 2,585,268 | 2/1952 | Olsen | 273/275 |
| 2,825,568 | 3/1958 | Birsh | 273/157 R |
| 2,881,546 | 4/1959 | Gauthier | 273/157 R |
| 3,309,092 | 3/1967 | Hardesty et al. | 273/157 R |
| 3,403,460 | 10/1968 | Barrows | 273/157 R |
| 3,643,956 | 2/1972 | Bovasso | 273/157 R |
| 3,707,287 | 12/1972 | Spector | 273/157 R |
| 4,021,939 | 5/1977 | May | 273/157 R |
| 5,108,291 | 4/1992 | Kuo | 273/157 R |

*Primary Examiner*—V. Millin
*Assistant Examiner*—Steven B. Wong
*Attorney, Agent, or Firm*—Bacon & Thomas

[57] ABSTRACT

A game board is provided with a square recess for receiving a plurality of cards having different patterns printed on opposite sides of the cards. When one side of the cards is exposed, a changeable maze game may be played. When the other side of the cards is exposed, a changeable character or picture game may be played. The periphery of the recess is provided with grooves for conveniently accessing the cards for their removal or rearrangement.

1 Claim, 6 Drawing Sheets

CHANGEABLE MAZE GAME

FIELD OF THE INVENTION

The present invention relates to a toy with changeful maze which is a new design, it particularly relates to the characteristic that, the structure is simple and special, the content of the game is momentarily changeful during playing, and the effects of increasing the ability of thinking and the mental reaction are achieved.

DESCRIPTION OF THE INVENTION

The consumer likes those toys which are used for amusement, and relaxation, so the market of that is stable. The kinds of toys available on the market are too many to cite, some are mechanical and some are electronic, and not only the shape of appearance is diversified but also the novelty of playing is kept by the effect of interest, and the growth in intelligence. So the business field pays much attention in the development of the toy with aforedescribed function. But looking over the toys available on the market, whatever form and design the toy uses, most of them is expensive and easy to be damaged, so the kind of toy which is cheap, easy to be produced, and suitable for all people regardless of age and sex is few. Moreover, the common toy with diversified function is few, so the aforementioned purpose of keeping the novelty is hard to be achieved. If a toy is designed with the basic function of interest and growing intelligence, and the characteristics of diversified change, freely adjusting the content of the game according to the need of the player, and being suitable for all people regardless of age and sex are also provided the attraction of such design is strongly increased. It is pleased, recreational, and able to increase intelligence for the foregoing design, but nowadays the toy with the aforementioned characteristics is still not available on the market.

According to the plenteous experience of the inventor, a changeful maze is designed finally and composed of special and simple components, the diversified change and a plurality of games are also provided in a single toy, and it is able to increase the ability of thinking and the mental reaction. So the creativity is satisfy in the toy of changeful maze.

SUMMARY OF THE INVENTION

The main object of this invention is to provide a toy with a plurality of games, such as maze, constituting character and picture, the structure of such design is composed of simple bottom board and cards. The passage connected to each other or the obstacle are constructed by different dark and light patterns on one side of the cards, different characters and pictures are constructed by different dark and light patterns on the other side for examining the power to think and regroup of the player. Then the reaction of mentality of the player is increased, and the amusement and the practical effect is achieved.

The other object of this invention is to provide a changeful maze the structure of which is easy to be designed. Although the component is pure, cheap, and easy to be produced, it is able to provide a plurality of games and suitable for all people regardless of age and sex, so such design is never seen before.

The characteristics of component, structure, and effect will be best understood from the following description when read in conjunction with the accompanying drawings.

DESCRIPTION OF THE NUMBER IN FIGURES

| | |
|---|---|
| 10. bottom board | 11. square groove |
| 12. groove | 13. corner |
| 14. light portion | 15. dark portion |
| 20. card | 21. light pattern (passage) |
| 22. dark pattern (obstacle) | |
| 23. light pattern (used for constituting character or as a passage of maze) | |
| 24. dark pattern (used for constituting character or as an obstacle of maze) | |

DETAIL DESCRIPTION OF THE INVENTION

Figure 1:
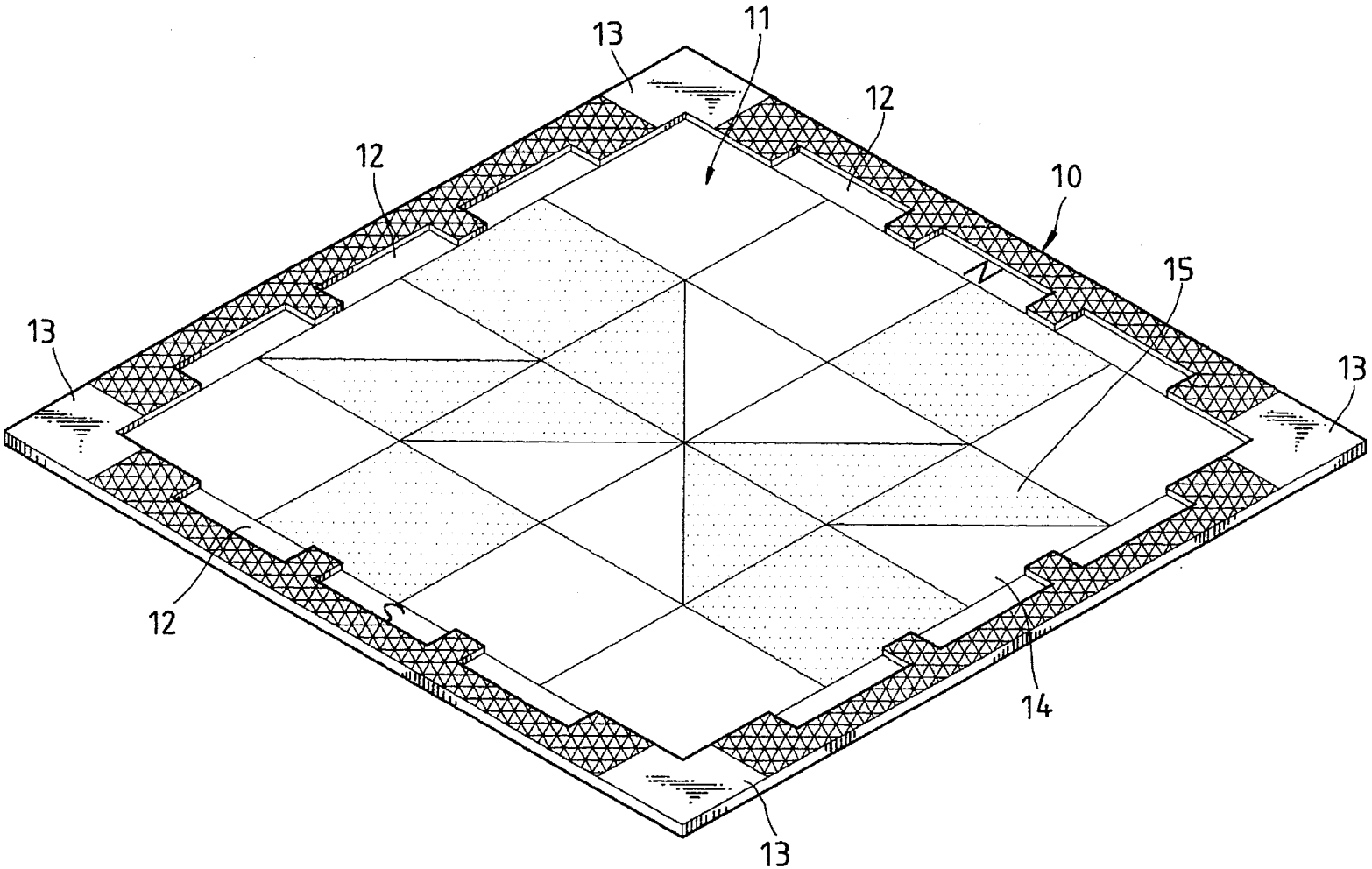
FIG. 1 is a perspective view of the bottom board in this invention.
Figure 2:
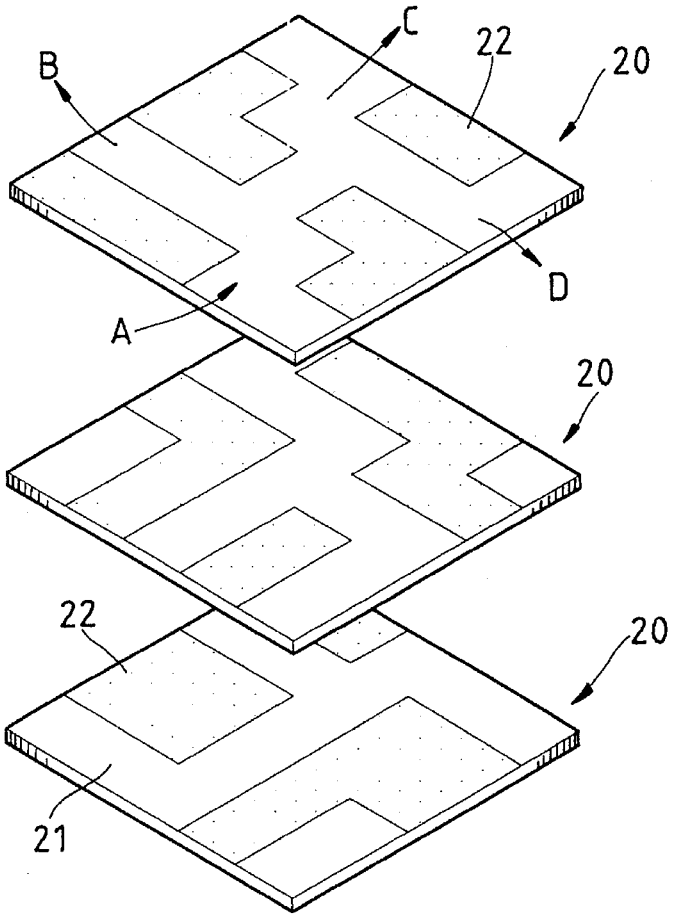
FIG. 2 is a perspective view of cards indicating the patterns which represent the passage and the obstacle on the surface.
Figure 3:
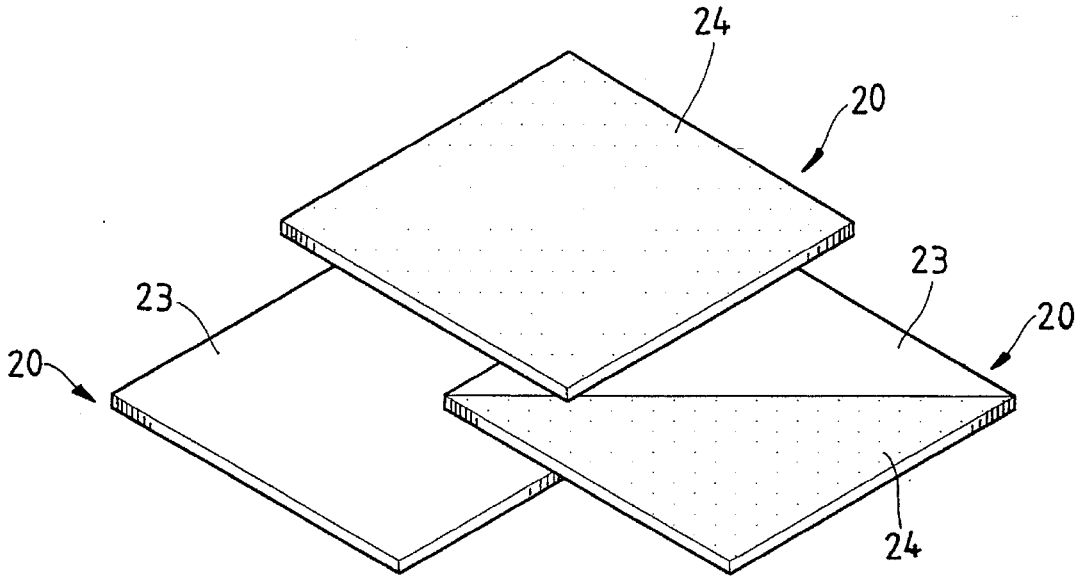
FIG. 3 shows the other surface of three cards indicating the dark and light patterns used for constituting character.

As shown in FIGS. 1, 2, and 3, the changeful maze is composed of a bottom board 10 and a plurality of square cards 20.

The bottom board 10 is a flat board, a square groove 11 the four edges of which are vertical to the bottom board i and the shape of which is concave is formed on the surface of the board, and the area inside the square groove 11 provides enough space for putting most cards. The square area with respect to the card 20 on the bottom of the square groove 11 is drawn with asymmetric patterns formed by light portion 14 and dark portion 15, a plurality of grooves 12 are formed on the four edges of the square groove 11, and the groove 12 the color of which is light is used to represent the passage or for turning the card 20 over in the square groove 11 conveniently. The corners 13 of the square groove 11 represent the exit and the entrance of the passage of the maze respectively.

As shown in FIGS. 2 and 3, the light pattern 21 and the dark one 22 which represent the passage and the obstacle of the maze individually is drawn on one side of each card 20, and the pattern are different for different cards. The light pattern 21 which represents the passage of the maze takes at least one corner of the card as the entrance A, and at least one or more exits B, C, D are arranged on the other corners or sides of the card. That the scale of the four sides is the same in most cards 20 for combining them arbitrarily is able to increase the amusement and difficulty of the maze during playing. One of the three types of patterns, the full dark one 24, the full light one 23, or half dark half light one divided by diagonal is drawn on the other side of the card 20 for constituting character.

Summarizing the aforedescribed main points of the design in the present invention, the key items provided for the need of the game are as follows:

1. The bottom board 10 is the leading role of the game, if it is used with one side of the card 20, the game of maze is provided, and if it is used with the other side of the card 20, the game of constituting character is provided.

2. The four corners of the bottom board 10 are used as the exits and the entrances of the passages of the maze.

3. The area of the square groove 11 on the surface of the bottom board 10 provides enough space for putting most cards 20 therein.

4. The grooves 12 formed on the four edges of the square groove 11 are used as the passage of the maze or for turning the cards over conveniently.

5. The asymmetric patterns formed by light, portion 14 and dark portion 15 are drawn on the bottom surface of the square groove 11 for providing the need of the game of maze or constituting character.

6. The dark pattern and the light pattern which represent the obstacle and the passage respectively are drawn on one side of each card 20, and the dark and the light pattern used for constituting character and picture are drawn on the other side.

7. Depending on the need of the game, all the cards or only a part of them are put into the square groove 11.

8. The dark and light patterns on the two sides of each card 20 can match that of the square groove 11 for providing the need of the game of maze.

9. The rules, such as moving the card or turning it over, for changing the location of passage and obstacle are defined by the player.

10. The game can be played by one people alone, two people or many people simultaneously.

The method of playing the game of the invention is described by the accompanying embodiments.

Figure 4:
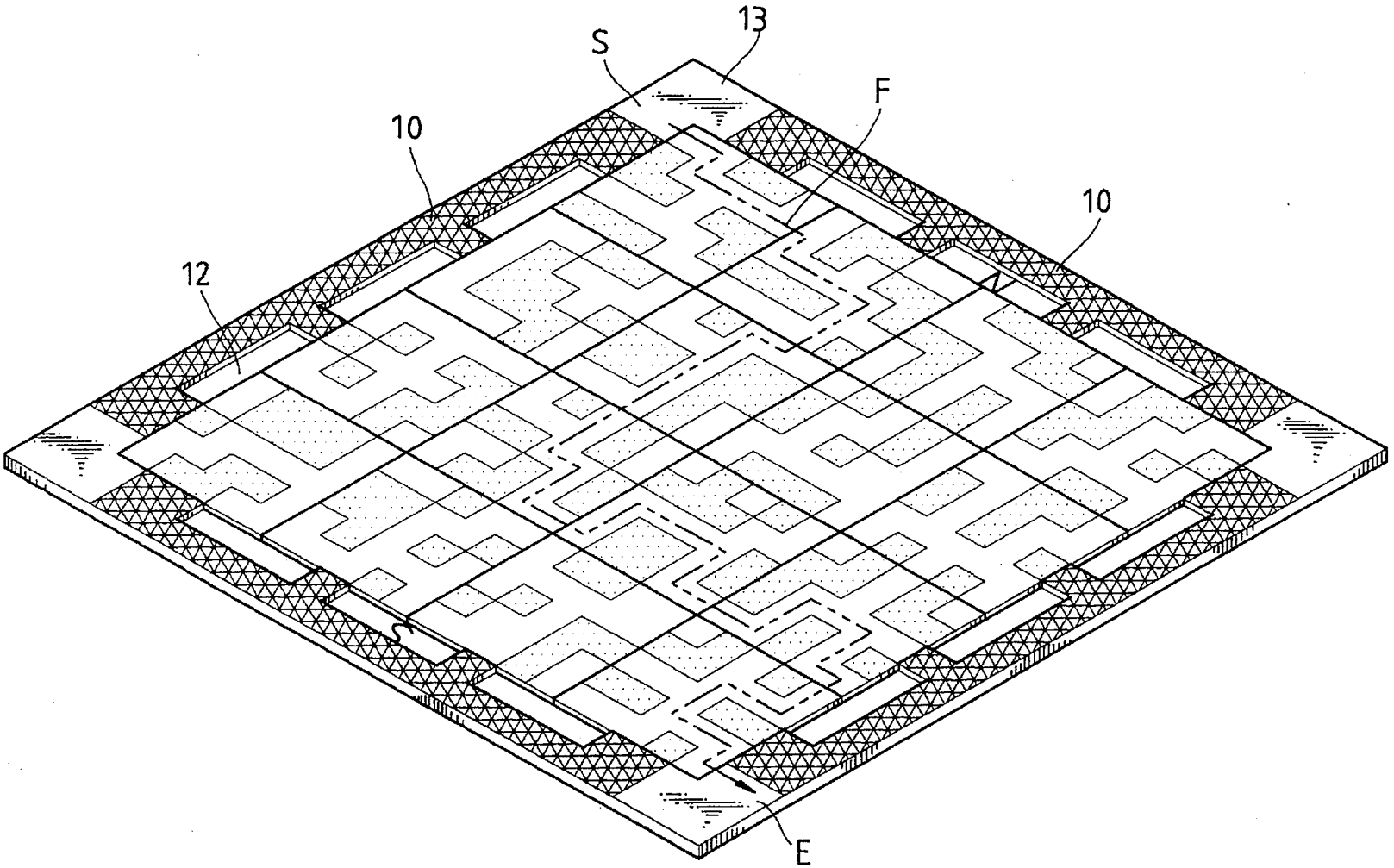
FIG. 4 shows the embodiment of one game of the maze in this invention.

FIG. 4 is an embodiment indicating the game of maze in this invention, mixing the 16 cards (this application is described by the embodiment the specification of which is 16 cards) the patterns of which are different on the surface in design before playing, and ten put the cards one by one in the square groove 11 of the bottom board 10 in unfixed order, as shown in FIG. 4. The passage and the obstacle are formed by the light pattern 21 and the dark one 22 respectively on the surface of connected cards 20, the player can take one corner S of the four corners 13 of the bottom board 10 as the start point, and then arrive the diagonal final point E through path F shown in FIG. 4.

Figure 5:
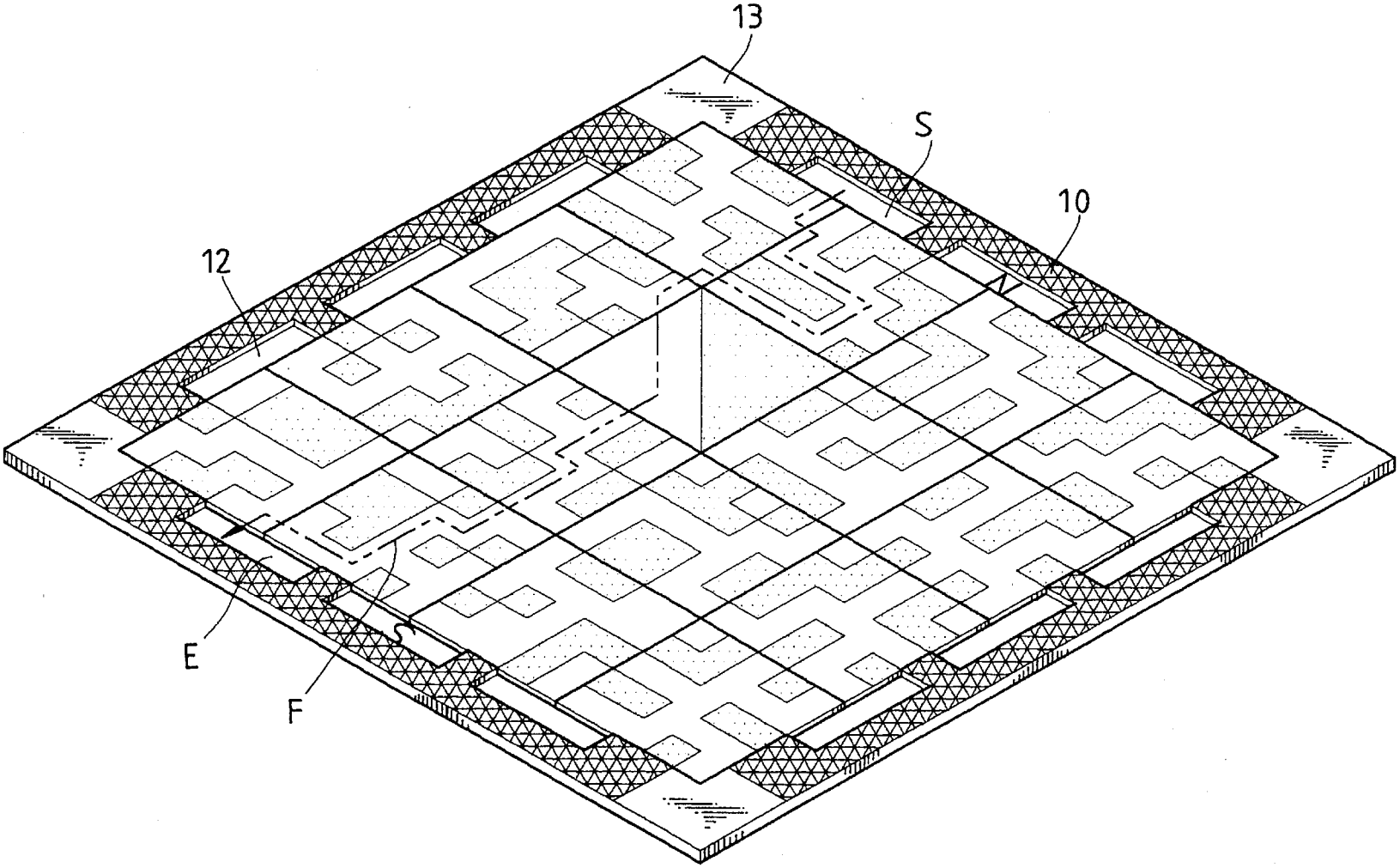
FIG. 5 shows the embodiment of another game of the maze in this invention.

That the different arrangement of the cards 20 can create only one path, many paths or no path which is like the path F described above increase the amusement of the game; the start point and the final point can also be defined on the corners which are not opposite to each other, as shown in FIG. 5, a groove 12 is defined as a start point and opposite that, is defined as a final point. When there is no path connecting the start and the final point, the game is played to turn a card over according to the rule set or aforedefined, as shown in FIG. 5, for forming an emergent, passage or obstacle which is still impassable by the dark and light patterns on the back of the card, or take a card away, move one, turn one over again, etc. by the rule. The great amusement of the game of the changeful maze is achieved when the purpose of arriving the final point is accomplished by different, operations of the game.

Figure 6:
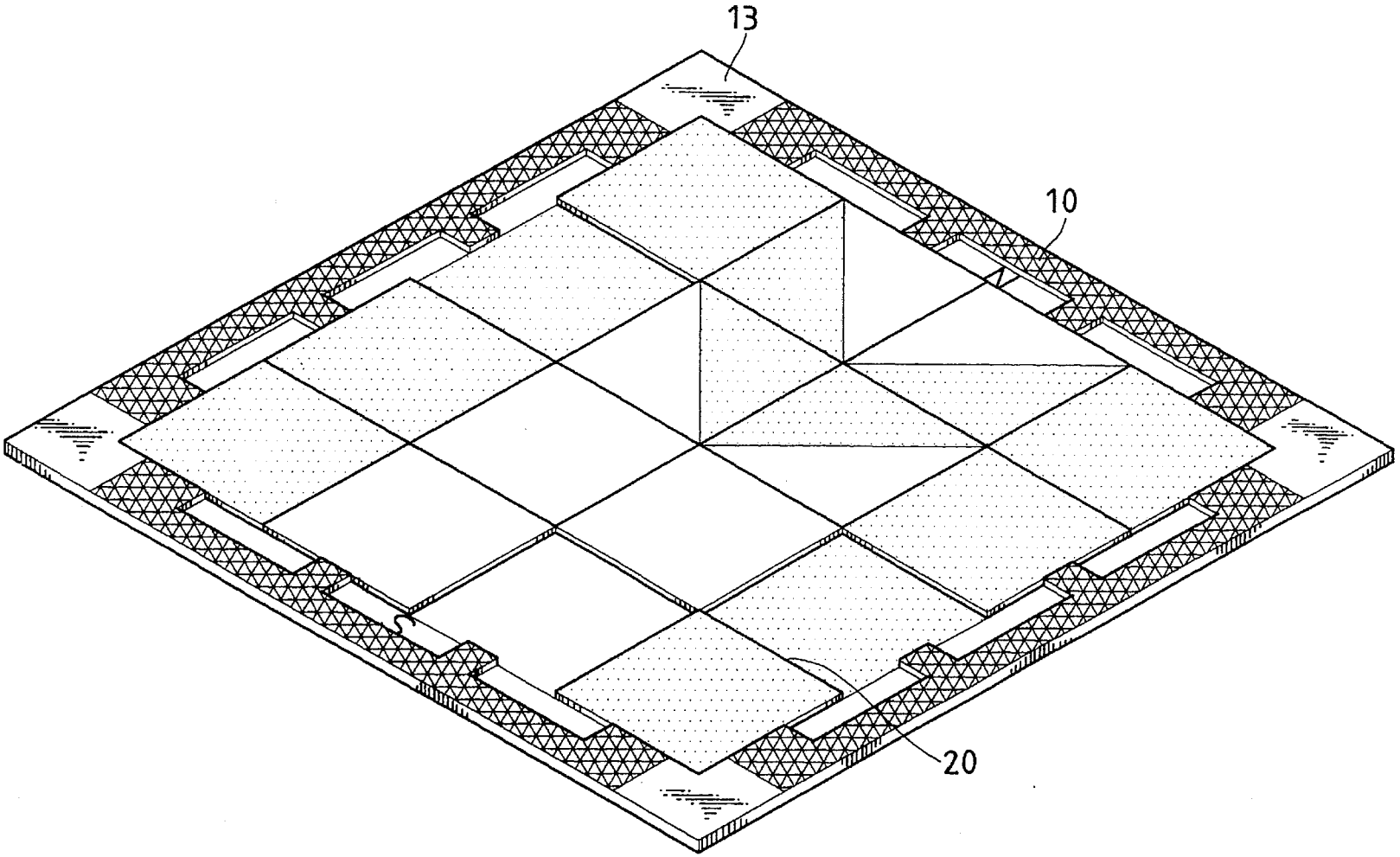
FIG. 6 shows the embodiment of the game of constituting character in this invention; and, FIG. 7 shows the embodiment of another game of constituting character in this invention.
Figure 7:
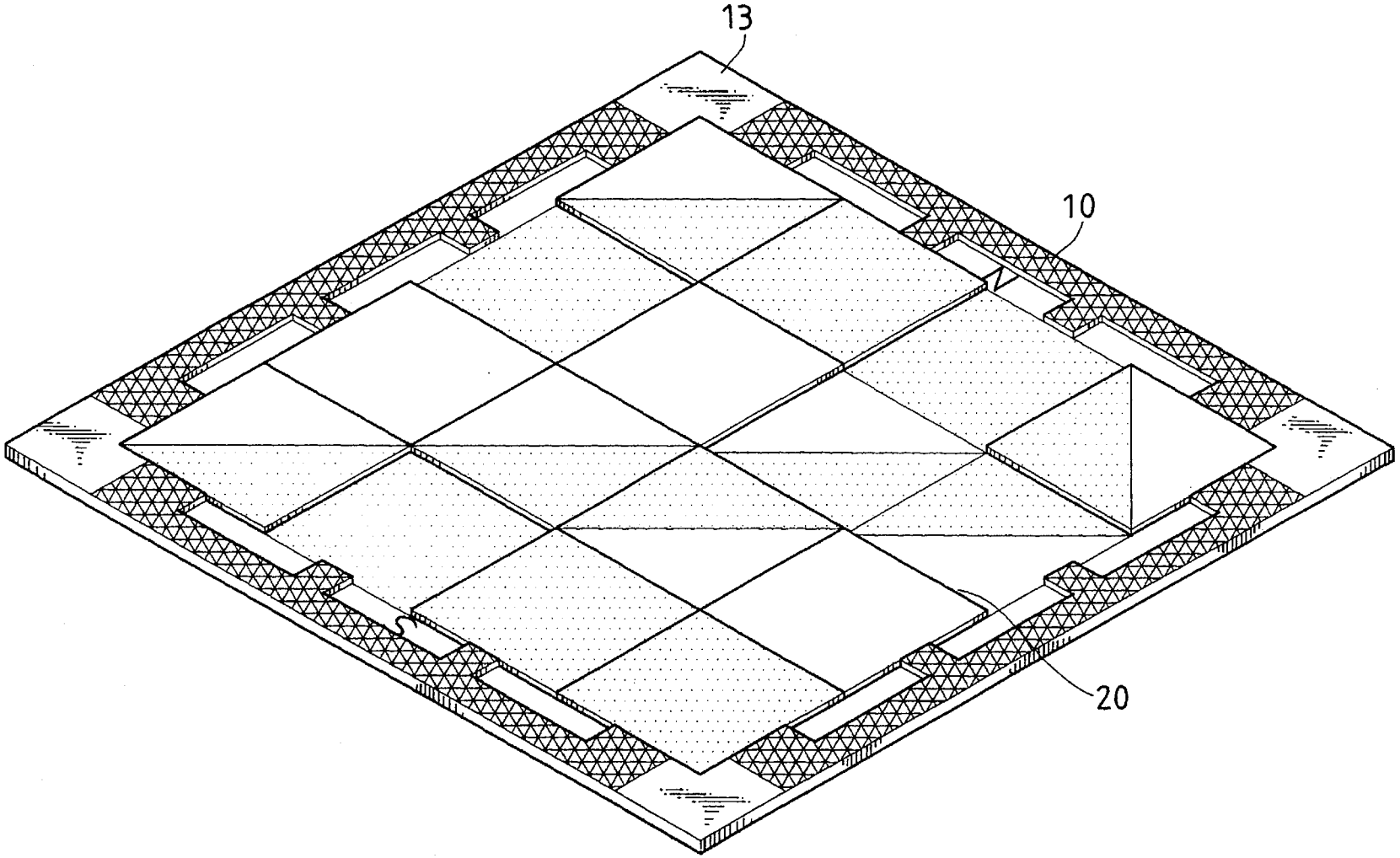

FIGS. 6 and 7 are the embodiments of playing the game of constituting character in this invention, choosing a certain quantity of cards before playing, and then put the cards on the proper position according to the light, and dark pattern of the square groove 11 for forming different characters, pictures (as the "M" shown in FIG. 6) and numerals (as the "2" shown in FIG. 7) by the dark pattern.

Thus, the invention described above is a toy of changeful maze the structure of which is composed of special component, the effect of diversified amusement is provided therein, so the creativity is satisfied. This invention is composed of simple structure, the amusement and the practical effect are also provided, and it is suitable for one, many, and different, ages of people to play. The rule of the law of patent, is satisfied for the foregoing purpose being achieved.

Having described preferred embodiments of a new and improved design for the toy in accordance with the present invention, it, is believed that other modifications, variations and changes will be suggested to persons skilled in the art in view of the teachings set forth herein. It is therefore to be understood that, all such variations, modifications and changes are believed to fall within the scope of the present invention as defined by the appended claims.

I claim:

1. A changeable maze game comprising:

a) a board of flat configuration provided with a square recess formed therein, the square recess being defined by four vertical edges and a bottom surface, the bottom surface being subdivided into a plurality of bottom squares provided with asymmetric light and dark portions;

b) a plurality of cards disposable within the square recess and alignable with the bottom squares, each card including a first surface and a second surface;

c) a plurality of grooves formed in the vertical edges of the square recess for permitting a user to remove cards positioned adjacent the vertical edges from the square recess;

d) the first sides of the cards being provided with different light and dark patterns for representing, respectively, passages and obstacles of a maze, each first side including at least one corner provided with a light pattern for defining an entrance of the maze and at least one light pattern at an opposite corner or a side of the first side for defining an exit of the maze; and e) each second side of the card being provided with one of three forms of patterns, including a full dark pattern, a full light pattern, or a diagonally divided half dark pattern and half light pattern for forming characters.

* * * * *